US006608602B2

(12) United States Patent
Waltho et al.

(10) Patent No.: US 6,608,602 B2
(45) Date of Patent: Aug. 19, 2003

(54) METHOD AND APPARATUS FOR A HIGH ISOLATION DUAL PORT ANTENNA SYSTEM

(75) Inventors: Alan E. Waltho, San Jose, CA (US); Jeffrey L. Schiffer, Palo Alto, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/005,738

(22) Filed: Nov. 6, 2001

(65) Prior Publication Data

US 2003/0085847 A1 May 8, 2003

(51) Int. Cl.[7] ..... H01Q 21/00
(52) U.S. Cl. ..... 343/850; 343/725
(58) Field of Search ..... 343/850, 725, 343/726, 727, 728, 741, 866, 845

(56) References Cited

U.S. PATENT DOCUMENTS 5,155,495 A * 10/1992 Hately et al. ..... 343/725
5,751,252 A * 5/1998 Phillips ..... 343/726
6,094,178 A * 7/2000 Sanford ..... 343/895
6,377,224 B2 * 4/2002 Gomez-Henry et al. .... 343/772

* cited by examiner

*Primary Examiner*—James Clinger
(74) *Attorney, Agent, or Firm*—Blakely, Sokoloff, Taylor & Zafman LLP

(57) ABSTRACT

An embodiment of a dual port antenna system includes a balanced 90° hybrid coupler integrated with a crossed-field antenna to provide stable high isolation between the two input ports of the system. Unlike conventional antennas, the crossed-field antenna is made up of two radiating elements separately fed at a phase difference of 90°. This allows all of the power from the two transmitters to be coupled to the antenna via the hybrid coupler. A balanced 90° hybrid coupler provides isolation between the two ports of the system by matching the electrical characteristics of the antenna. The isolation between ports provided by the balanced 90° hybrid coupler is approximately 35–40 db which is sufficient to allow the independent operation of transceivers connected to the input ports. The crossed-field antenna exhibits loose electrical coupling so that the electrical characteristics remain stable and sufficiently high isolation between input ports is maintained.

14 Claims, 3 Drawing Sheets

METHOD AND APPARATUS FOR A HIGH ISOLATION DUAL PORT ANTENNA SYSTEM

FIELD OF THE INVENTION

The present invention relates generally to dual port antenna systems, and more specifically to reducing the interference between connected transceivers.

BACKGROUND OF THE INVENTION

In recent years there has been an intense effort to provide increased functionality of mobile personal computing systems while at the same time decreasing the size of such systems. This has led to a desire to incorporate two transceivers within small computing systems such as notebook computers or PDAs. For example one transceiver may be used to provide a wireless connection between a laptop and a printer or mouse while another transceiver may be used to provide a wireless Ethernet (network) connection. The problem with having two transceivers in the same mobile computing device is that if the two transceivers are collocated with their antennas closely coupled, they will interfere with each other. This means that a portion of the power from one transceiver will enter, and interfere with, the other transceiver. For example, when the Ethernet connection is transmitting it may disrupt the wireless mouse connection and vice versa.

Various designs are being considered to electrically isolate the transceivers. Today, typical levels of electrical isolation in laptop devices are in the range of, approximately, 15–20 db. This is a measure of the relative signal strength of one transmitter received by, and impacting the performance of, the other transceiver. An isolation of 15–20 db indicates that about 1–2% of the power from one transceiver is interfering with the operation of the other transceiver.

This level of isolation is not sufficient to allow acceptable operation of both transceivers. In order for both transceivers to function properly, a level of isolation between the transceivers of approximately 35–40 db may be required.

BRIEF DESCRIPTION OF THE DRAWINGS

The present invention is illustrated by way of example, and not limitation, by the figures of the accompanying drawings in which like references indicate similar elements and in which.

DETAILED DESCRIPTION

Figure 1A:
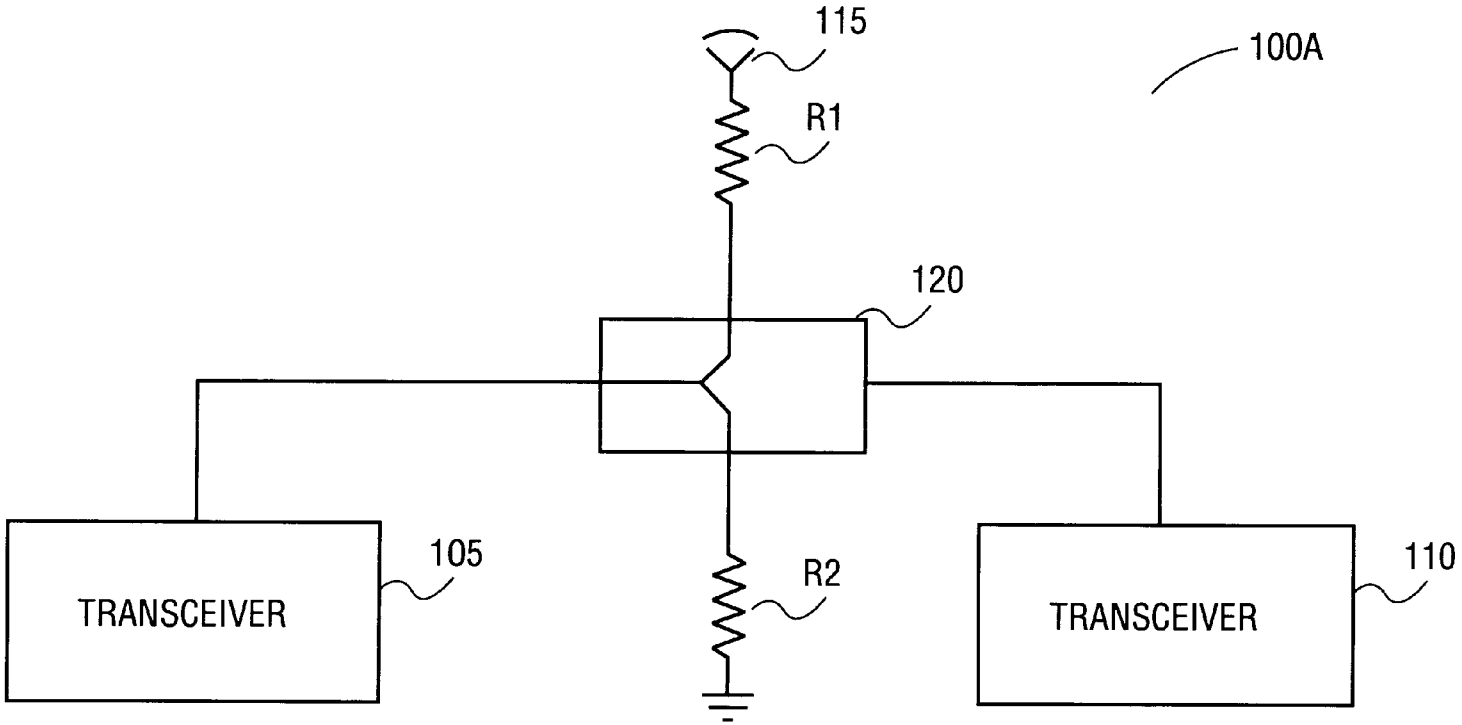
FIG. 1A illustrates the use of a hybrid coupler to provide isolation between two transceivers.

An embodiment of a dual port antenna system includes a crossed-field antenna coupled with a 90° hybrid coupler and connected to a pair of transceivers. Unlike conventional antennas, the crossed-field antenna is made up of two radiating elements separately fed at a phase difference of 90°. This allows all of the power from the two transmitters to be coupled to the antenna via the hybrid coupler. The hybrid coupler connection to the electrically balanced points of the crossed-field antenna provides high isolation between the transceivers. The isolation remains stable and independent of the coupling between the antenna and surrounding objects. This is due to the properties of the crossed-field antenna which, due to low coupling to surrounding objects provides a near constant impedance and minimizes electrical mismatch in the hybrid coupler. Use of a crossed-field antenna also allows for reduced antenna size for a given operating frequency. In general, an embodiment of the invention may be employed in situations where it is desired to increase the isolation between the two ports of a dual port antenna system. A specific embodiment of the invention may be used in mobile computing systems where design constraints regarding the placement of antennas are significant. An embodiment of the invention provides higher efficiency than may be obtained from a configuration as shown in FIG. 1A.

The level of isolation between two transceivers, incorporated within a mobile computing device, required for proper performance may be 35–40 db. Under certain conditions, this may be obtained with a balanced hybrid coupler feeding a conventional antenna. FIG. 1A illustrates the use of a balanced hybrid coupler to provide isolation between two transceivers. This configuration has a minimum insertion loss of 3 db. A conventional antenna, when operating at or near its intended frequency, is basically, electrically, a resistive element. That is, the antenna approximates, for example, a 50 ohm load. System 100A, shown in FIG. 1A, includes transceivers 105 and 110 coupled through hybrid coupler 120 to antenna 115. The resistance R1 represents the electrical characteristic of antenna 115. Resistance R2 is selected to have a resistance equal to resistive load of the antenna, resistance R1. When resistance R1, is nearly equal to resistance R2, power from transceiver 105 is absorbed equally by both loads and very little of the power from the signal of transceiver 105 is transferred to transceiver 110. For example, matched resistive loads may yield an isolation of 40 db. If the resistance is not well matched to that of the antenna a significant portion of the power from transmitter 105 would be transferred to transceiver 110. An open circuit would provide an isolation of only 3–4 db.

Figure 1B:
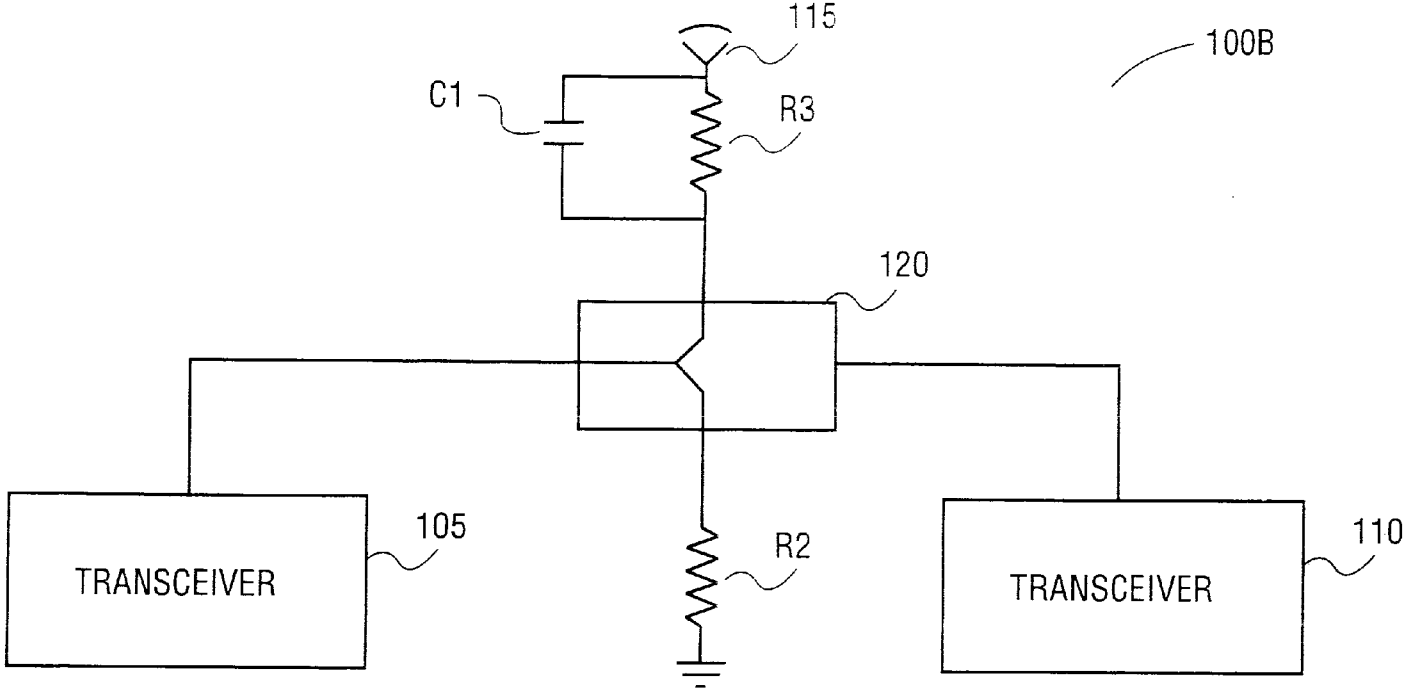
FIG. 1B illustrates the dynamic electrical characteristics of an antenna in ordinary use.

The use of a hybrid coupler to increase isolation between transceivers in personal computing devices has a significant drawback. System 100A relies on the resistive load of the antenna being equal to the resistance R2 implemented in the circuit. During normal use, the resistive load of a laptop antenna may change drastically as shown in FIG. 1B. This is because, in general, antenna length is a function of operating frequency with the antenna length being equal to one half the wavelength. Transceivers incorporated into computing systems operate at frequencies of several gigahertz, yielding an antenna length of several centimeters. A dipole antenna of a transceiver in a computing system is typically on the order of 5 cm long. The electrical characteristics of many antennas of this size are significantly affected by close objects. System 100B, shown in FIG. 1B, shows the electrical characteristics of the antenna 115 changed by coupling with nearby objects. The electrical characteristics of the antenna 115 are now represented by resistance R3 and capacitance C1. This added impedance may be caused by any number of circumstances that are typical in the ordinary use of a mobile computing system. For example, a laptop operator merely moving his hand near the antenna 115 may add capacitance to the electrical characteristic of the antenna changing its overall impedance. System 100B is not electrically balanced and therefore does not have the high degree of isolation present in system 100A.

The delicately balanced hybrid coupler can be made more robust by replacing standard antenna 115 with an antenna that has two separately fed elements and exhibits loose electrical coupling to nearby objects. A suitable antenna may be a crossed-field antenna. A conventional antenna is comprised, basically, of a single conductive element with a length of approximately one-half the operating wavelength. Crossed-field antennas, which are known in the art, were developed to reduce the size of radio broadcast antennas. Crossed-field antennas have two separate elements. One of the elements produces a high frequency electric field and the other produces a high frequency magnetic field. One attribute of crossed-field antennas is that they couple very loosely, electrically, to nearby objects. This means that the electrical characteristics of the crossed field antenna will not drastically vary with normal operations of a mobile computing device.

Moreover, crossed-field antennas may be significantly smaller than one-half of the operating wavelength. Standard antennas are typically one-half of a wavelength in size or perhaps as small as one-quarter of a wavelength. Reducing the dimension of a standard antenna beyond this point results in reduced transmission efficiency due to increased circulation currents that cause large conductor and magnetic core losses. A crossed-field antenna may be 1/20 of a wavelength, or smaller, and still transmit efficiently. The length of a crossed-field antenna for use in the several gigahertz range need only be approximately 4–5 millimeters in contrast to a length of 4–5 centimeters for a standard antenna at comparable frequencies. This dramatic reduction in antenna size is extremely beneficial in mobile computing system applications. Therefore the use of a crossed-field antenna in laptop computers addresses the additional concern of limited space.

Figure 2:
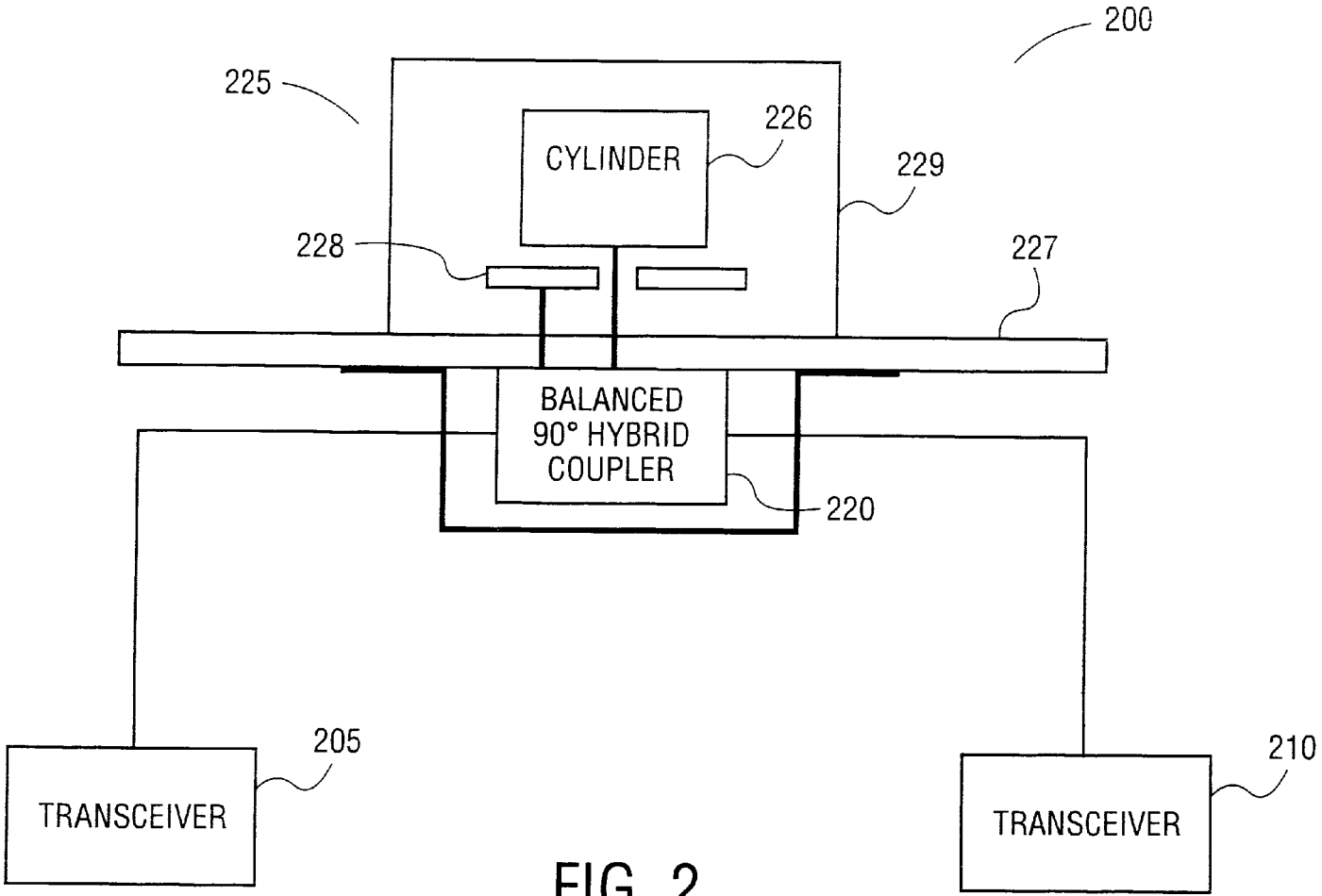
FIG. 2 illustrates a crossed-field antenna integrated with a 90° hybrid coupler to form a dual port antenna system in accordance with one embodiment of the present invention.

FIG. 2 illustrates a crossed-field antenna integrated with a 90° hybrid coupler to form a dual port antenna system in accordance with one embodiment of the present invention. The system 200, shown in FIG. 2, includes transceiver 205 and transceiver 210, connected to a balanced 90° hybrid coupler 220. The balanced hybrid coupler 220 provides sufficiently high isolation between the two receivers to allow both transceivers to be used at the same time (i.e., greater than 35 db isolation). Integrated with the balanced hybrid coupler 220 is a crossed-field antenna 225. In one embodiment, crossed-field antenna 225 consists, basically, of a hollow cylindrical conductor 226, a ground plane 227 that serves to shield the antenna from the electronics that feed the antenna, and a conducting plate 228. The cylinder 226, the ground plane 227, and the conducting plate 228 may be made of copper or some electrically similar material. The crossed-field antenna 225 may also have a radome (a protective housing for antennas that is transparent to radio waves) 229.

In operation, an electric field is produced by applying a voltage between the cylindrical conductor 226 and the ground plane 227. A magnetic field is produced by applying voltage between the ground plane 227 and the conducting plate 228. The two element systems which produce an electric field and a magnetic field, respectively, are positioned so that a common interaction zone of both fields is stressed. This creates the source from which radio waves radiate. Unlike a conventional antenna, a crossed-field antenna exhibits a very loose electrical coupling with nearby structures. That is, the electrical characteristics of a crossed-field antenna are not subject to drastic change as are those of a conventional antenna.

Thus, one embodiment offers high isolation between the two input ports of the antenna system. Unlike other configurations the isolation remains stable and independent of the coupling between the antenna and surrounding objects. Therefore a dual port antenna system that integrates a balanced 90° hybrid coupler with a crossed-field antenna may provide a highly isolated and stable system. When integrated with an electrically stable crossed-field antenna, the 35–40 db isolation provided by a balanced 90° hybrid coupler will not be degraded by nearby structures.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative sense rather than a restrictive sense.

What is claimed is:

1. An apparatus comprising:

a balanced hybrid coupler, the hybrid coupler providing isolation between a first port and a second port of a dual port antenna system, the first port having a first transceiver connected thereto and the second port having a second transceiver connected thereto; and a crossed-field antenna integrated with the balanced hybrid coupler, the antenna having two separately fed, radiating elements that provide an attribute of loose electrical coupling.

2. The apparatus of claim 1 wherein the balanced hybrid coupler is a balanced 90° hybrid coupler.

3. The apparatus of claim 1 wherein the isolation between the first port and the second port is greater than 35 db.

4. The apparatus of claim 3 wherein the dual port antenna system is implemented within a platform hosting two transceiver devices.

5. The apparatus of claim 3 wherein an electrical characteristic of the antenna is stable such that the isolation between the first port and the second port remains sufficiently high that independent operation of the first transceiver and the second transceiver may occur.

6. A method comprising:

implementing a balanced 90° hybrid coupler in a dual port antenna system, the dual port antenna system having a first transceiver connected to first port and a second transceiver connected to a second port; and integrating a crossed-field antenna with the balanced 90° hybrid coupler.

7. The method of claim 6 wherein the balanced 90° hybrid coupler provides isolation between the first port and the second port, the isolation greater than 35 db.

8. The method of claim 6 wherein an impedance of the crossed-field antenna is stable such that the isolation between the first port and the second port remains sufficiently high during operation of the dual port antenna that independent operation of the first transceiver and the second transceiver may occur.

9. The method of claim 6 wherein the dual port antenna system is implemented within a platform hosting two transceivers.

10. A dual port antenna system comprising:

a balanced hybrid coupler, the hybrid coupler providing isolation between a first port and a second port, the first port having a first transceiver connected thereto and the second port having a second transceiver connected thereto; and a crossed-field antenna integrated with the balanced hybrid coupler, the antenna exhibiting loose electrical coupling.

11. The dual port antenna system of claim 10 wherein the balanced hybrid coupler is a balanced 90° hybrid coupler.

12. The dual port antenna system of claim 10 wherein the isolation between the first port and the second port is greater than 35 db.

13. The dual port antenna system of claim 12 wherein an impedance of the antenna is stable such that the isolation between the first port and the second port remains sufficiently high that independent operation of the first transceiver and the second transceiver may occur.

14. The dual port antenna system of claim 12 implemented within a platform hosting two transceivers.

* * * * *